US010066546B2

(12) United States Patent
Yamashita et al.

(10) Patent No.: US 10,066,546 B2
(45) Date of Patent: Sep. 4, 2018

(54) INTERNAL COMBUSTION ENGINE

(71) Applicant: TOYOTA JIDOSHA KABUSHIKI KAISHA, Toyota-shi, Aichi-ken (JP)

(72) Inventors: Hideo Yamashita, Mishima (JP); Akio Kawaguchi, Shizuoka-ken (JP); Hiroki Iguma, Shizuoka-ken (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/358,803

(22) Filed: Nov. 22, 2016

(65) Prior Publication Data

US 2017/0152795 A1 Jun. 1, 2017

(30) Foreign Application Priority Data

Nov. 26, 2015 (JP) ..... 2015-230298

(51) Int. Cl.

| | |
|---|---|
| ***F02B 77/11*** | (2006.01) |
| ***F02B 77/08*** | (2006.01) |
| ***F02F 11/00*** | (2006.01) |
| ***F02F 3/10*** | (2006.01) |

(52) U.S. Cl.

CPC ..... *F02B 77/11* (2013.01); *F02B 77/085* (2013.01); *F02F 3/10* (2013.01); *F02F 11/002* (2013.01); *F05C 2251/048* (2013.01)

(58) Field of Classification Search

CPC . F02B 77/11; F02B 77/085; F02F 3/10; F02F 11/002; F05C 2251/048

See application file for complete search history.

(56) References Cited

U.S. PATENT DOCUMENTS

| | | | | |
|---|---|---|---|---|
| 2011/0239749 | A1* | 10/2011 | Toth | F02B 77/085 73/114.18 |
| 2012/0042859 | A1* | 2/2012 | Sakai | F02F 1/00 123/668 |
| 2013/0146041 | A1* | 6/2013 | Hijii | C25D 11/04 123/668 |
| 2017/0051713 | A1* | 2/2017 | Peters | F02M 53/046 |
| 2017/0156891 | A1* | 6/2017 | Hubert | A61F 2/4657 |

FOREIGN PATENT DOCUMENTS

| | | | |
|---|---|---|---|
| JP | S58-132177 | U | 9/1983 |
| JP | S60-98742 | U | 7/1985 |
| JP | H01-151722 | A | 6/1989 |
| JP | H08-312369 | A | 11/1996 |

(Continued)

*Primary Examiner* — Joseph Dallo
*Assistant Examiner* — Kurt Liethen
(74) *Attorney, Agent, or Firm* — Hunton Andrews Kurth LLP

(57) ABSTRACT

A heat shield film is formed on a bottom surface of a cylinder head and a heat shield film is formed on an inner peripheral surface of a small diameter hole portion. The film is a thermal spraying film made from the same film material. Since the film is thicker than the film, the film has higher thermal capacity than the film and thus heat retaining effect of the film is higher than that of the film. Therefore, combustion gas generated in a combustion chamber is suppressed to lose its momentum around the portion. Even if the combustion gas goes off around the portion, excessive temperature decrease of the combustion gas in the portion is suppressed.

2 Claims, 6 Drawing Sheets

(56) References Cited

FOREIGN PATENT DOCUMENTS

| | | | |
|---|---|---|---|
| JP | H10-252609 | A | 9/1998 |
| JP | 2000-170628 | A | 6/2000 |
| JP | 2005-214042 | A | 8/2005 |
| JP | 2007-303419 | A | 11/2007 |
| JP | 2008-101989 | A | 5/2008 |
| JP | 2010-249008 | A | 11/2010 |
| JP | 2012-072749 | A | 4/2012 |
| JP | 2013-227911 | A | 11/2013 |

* cited by examiner

INTERNAL COMBUSTION ENGINE

CROSS-REFERENCE TO RELATED APPLICATION

The present application claims priority to Japanese Patent Application No. 2015-230298 filed on Nov. 26, 2015, which is incorporated herein by reference in its entirety.

BACKGROUND

Technical Field

The present application relates to an internal combustion engine, and more particularly, to an internal combustion engine comprising a bottom surface of a cylinder head on which a heat shield film is formed.

Background Art

JP 2010-249008 A discloses an art to form an anodizing film on a wall surface of a combustion chamber of an internal combustion engine. The anodizing film has lower thermal conductivity than a metal base material consisting of the combustion chamber (e.g. aluminum alloy, magnesium ally, titanium alloy). Therefore, when the anodizing film is formed on the wall surface, thermal shield performance of the combustion chamber is improved and also cooling loss of the combustion chamber is reduced. Such art is also disclosed in JP 2012-072749 A.

In a gasoline type internal combustion engine, there is an engine with the cylinder head to which a fuel injector (hereinafter referred to as a "cylinder injector") is mounted. In addition to the cylinder injector, some engine comprise a sensor to detect pressure in the combustion chamber (hereinafter referred to as a "cylinder pressure sensor"). In a diesel type internal combustion engine, there is an engine with the cylinder head to which a glow plug combined with the cylinder pressure sensor is mounted.

For the mounting of the cylinder injector or the cylinder pressure sensor, an exclusive installation hole is generally formed in the cylinder head. In such case, however, fuel not contributing to combustion (hereinafter referred to as "unburnt HC") easily occurs in the combustion chamber. The reasons are that combustion gas tends to lose its momentum to go off around an opening portion of the installation hole at the combustion chamber side and thus temperature of the opening portion easily goes down. Since unburned HC leads to deterioration of thermal efficiency of the internal combustion engine, it is desirable to suppress occurrence of unburned HC.

Unburned HC is sometimes thermally decomposed into gummy matter (hereinafter referred to as "deposit"). Moreover, the accumulation of deposit on the opening portion may increase risk of developing various troubles. That is, in case of the cylinder injector, shape of fuel injected therefrom (i.e. spray shape of the injected fuel) might change from the original form, and/or flow mass of fuel supplied to the combustion chamber might decrease from the estimated flow mass. In case of the cylinder pressure sensor, an output error thereof might become large. In addition to that, when deposit falls from the opening portion, the fallen deposit might induce abnormal combustion. Even from such a point of view, it is desirable to suppress occurrence of unburned HC.

However, JP 2010-249008 A or JP 2012-072749 A mentions mainly about the heat shield film like the anodized film formed on the bottom surface of the cylinder head which occupies a part of the wall surface of the combustion chamber whereas being silent to the view in suppressing occurrence of unburned HC in the combustion chamber.

SUMMARY

In view of at least one of above described problems, an object of the present application is to suppress occurrence of unburned HC in the internal combustion engine where the cylinder injector or the cylinder pressure sensor is mounted to the cylinder head, on the bottom surface of which the heat shield film is formed.

An internal combustion engine of the present application comprises a cylinder head with an installation hole to which a sensor configured to detect pressure in a combustion chamber or an injector configured to inject fuel in the combustion chamber is mounted. The cylinder head comprises a heat shield film which has lower thermal conductivity than a base material of the cylinder head. The heat shield film is formed on both a bottom surface of the cylinder head and an inner peripheral surface of the installation hole. The film material of the heat shield film on the bottom surface is the same as that of the heat shield on the inner peripheral surface. The heat shield film on the inner peripheral surface is thicker than that of the heat shield on the bottom surface.

In the internal combustion engine of the present application, the inner peripheral surface may comprise a seal surface configured to contact with a part of the sensor or the injector so as to seal between the inner peripheral surface and the combustion chamber. In this case, the heat shield film on the inner peripheral surface may be formed on an area nearer to the combustion chamber than the seal surface whereas the base material may be exposed in an area further to the combustion chamber than the seal surface.

According to the internal combustion engine of the present application, the heat shield film with lower thermal conductivity than a base material of the cylinder head is formed on both the bottom surface of the cylinder head and the inner peripheral surface of the installation hole. Therefore, thermal shield performance of the combustion chamber is improved and also cooling loss of the combustion chamber is reduced. In addition to that, according to the internal combustion engine of the present application, since the heat shield film on the inner peripheral surface is thicker than that of the heat shield on the bottom surface, heat retention performance of the heat shield on the inner peripheral surface is enhanced in comparison to that of the heat shield on the bottom surface. Therefore, the combustion gas is suppressed to lose its momentum around an opening portion of the installation hole at the combustion chamber side. Even if the combustion gas goes off around the opening portion, excessive temperature decrease of the combustion gas in the opening portion is suppressed. For the reasons described above, occurrence of unburned HC inner the installation hole is suppressed.

When the heat shield film on the inner peripheral surface is formed on the area nearer to the combustion chamber than the seal surface whereas the base material is exposed in the area further to the combustion chamber than the seal surface, heat of the combustion gas can be easily released into the cylinder head via the area further to the combustion chamber than the seal surface. Therefore, an excessive rise in temperature of the sensor or the injector is suppressed and thus, occurrence of thermal distortion in components of the sensor or the injector and that of troubles in the sensor or the injector can be decreased.

DETAILED DESCRIPTION

Figure 1:
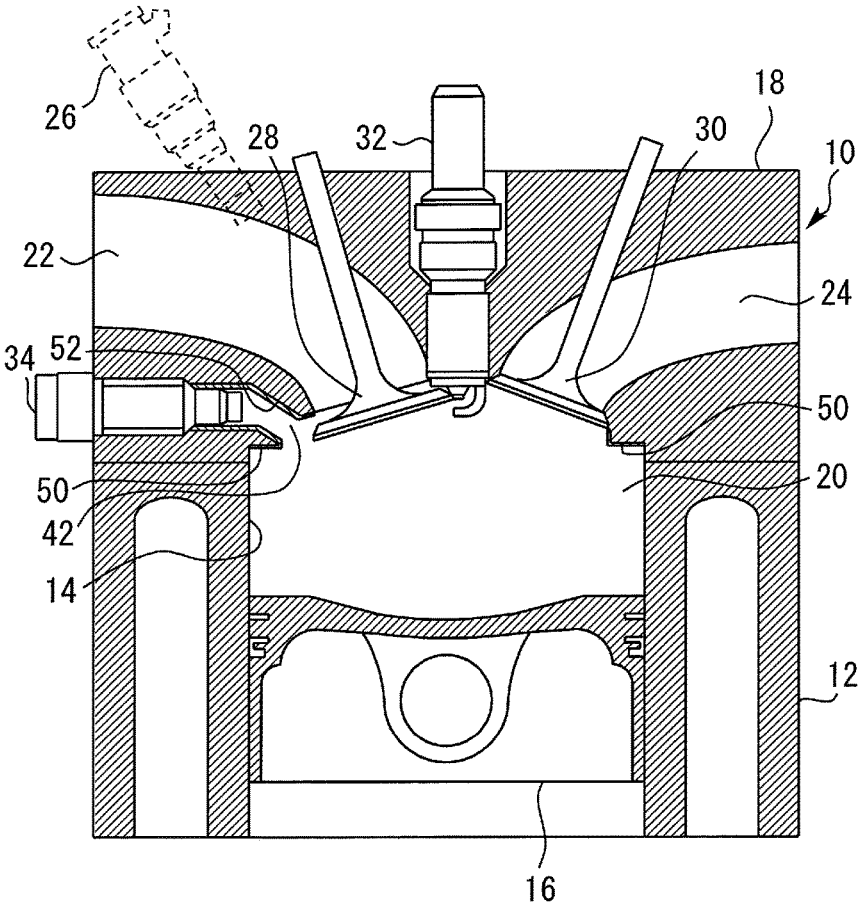
FIG. 1 is a diagram for describing a construction example of an internal combustion engine in a first embodiment of the present application.

Embodiments of the present application are described hereunder referring to figures. Note that elements that are common to the respective drawings are denoted by the same reference characters and a duplicate description thereof is omitted. Moreover, the present application is not limited to the embodiments described hereunder.

First Embodiment

An internal combustion engine of a first embodiment of the present application is a spark ignition type internal combustion engine installed in a moving vehicle such as car. FIG. 1 is a diagram for describing a construction example of an internal combustion engine in a first embodiment of the present application. As shown in FIG. 1, the internal combustion engine 10 comprises a cylinder block 12 in which a cylinder 14 is formed, a piston 16 which is housed in the cylinder 14 and is configured to move in a vertical direction, and a cylinder head 18 which is mounted on the cylinder head 12. A combustion chamber 20 is defined at least from a wall surface of the cylinder 14, a top surface of the piston 16 and a bottom surface of the cylinder head 18.

On the cylinder head 18, an intake port 22 and an exhaust port 24 are formed with which the combustion chamber is communicated. On the intake port 22, an injector 26 (port injector) that is configured to inject fuel into the intake port 22 is mounted. On a connection port between the combustion chamber 20 and the intake port 22, an intake valve 28 is mounted. Also, on a connection port between the combustion chamber 20 and the exhaust port 24, an exhaust valve 30 is mounted. These valves includes umbrella portions, bottom surface of which constitute a wall surface of the combustion chamber 20 in company with the wall surface of the cylinder 14, the top surface of the piston 16 and the bottom surface of the cylinder head 18.

On the cylinder head 18, a spark plug 32 and a cylinder pressure sensor 34 are installed. The spark plug 32 includes a center electrode and a ground electrode. The spark plug 32 is configured to ignite mixed gas in the combustion chamber 20 by applying a voltage and generating a spark between the electrodes. The cylinder pressure sensor 34 is configured to detect pressure in the combustion chamber 20.

Figure 2:
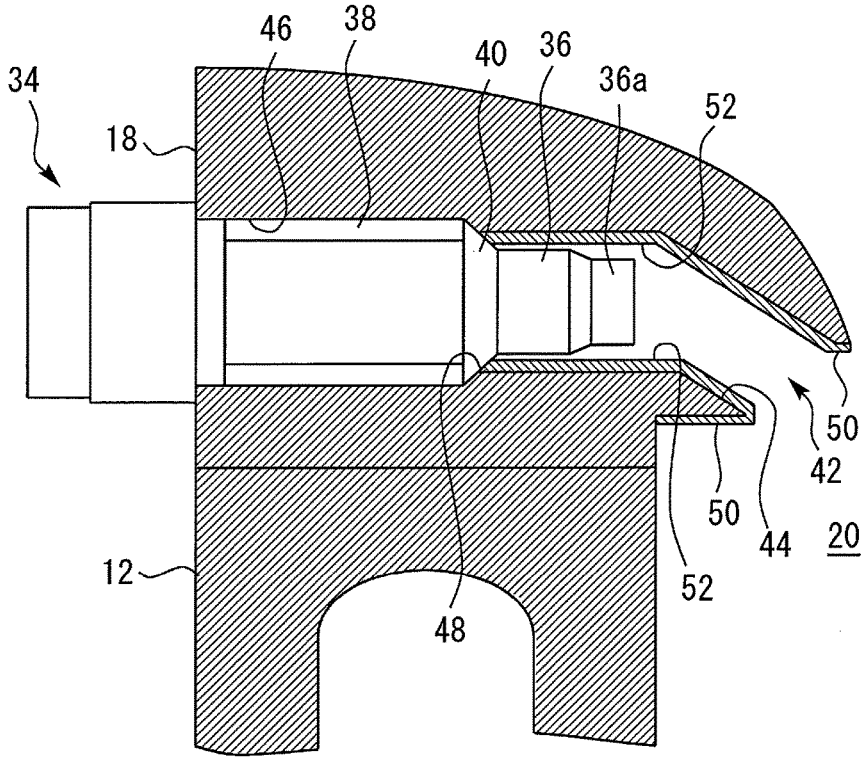
FIG. 2 is a diagram for showing a mounting structure example of the cylinder pressure sensor of FIG. 1.

For example, the cylinder pressure sensor 34 is constructed as shown in FIG. 2. The cylinder pressure sensor 34 of FIG. 2 comprises a small diameter portion 36 including a pressure receive portion 36*a* which is located at the tip of the sensor 34, a large diameter portion 38 which has larger diameter than the small diameter portion 36 and is located at the base side of the sensor 34, and a stepped portion or shoulder portion 40 which is located between the small diameter portion 36 and the large diameter portion 38. On an outer peripheral of the large diameter portion 38, a male screw is formed to screw with a female screw described below. The shoulder portion 40 is formed by an annular tapering conical surface.

The cylinder pressure sensor 34 of FIG. 2 is a semiconductor type pressure sensor comprising an element portion (not shown) which is configured to output a signal depending on pressure added thereto and a transmission member (not shown) which is configured to transmit pressure added to the pressure receive portion 36*a* to the element portion. Note that a pressure sensor of various type can be used in this embodiment other than the pressure sensor described above. For example, an optical type cylinder pressure sensor can be used, which is configured to detect pressure based on intensity of light reflected back by a sensor diaphragm reacting to pressure.

As shown in FIG. 2, an installation hole 42 is formed on the cylinder head 18 in which the cylinder pressure sensor 34 is housed. The installation hole 42 comprises a small diameter hole portion 44 which opens at one end into the combustion chamber 20 and bends at midway to enclose the small diameter portion 36 without contacting, the large diameter hole portion 46 which has larger diameter than the small diameter hole portion 44, and a stepped portion 48 which is located between the small diameter hole portion 44 and the large diameter hole portion 46. The female screw is formed on an inner peripheral of the large diameter hole portion 46 by which the cylinder pressure sensor 28 is housed in the installation hole 42. When the large diameter portion 38 is screwed into the large diameter hole portion 46, the shoulder portion 40 contacts with the stepped portion 48 to seal between them.

As shown in FIGS. 1 and 2, a heat shield film (hereinafter referred to as a "head bottom surface film") 50 is formed on the bottom surface of the cylinder head 18 which constitutes a part of the wall surface of the combustion chamber 20. Also, a heat shield film (hereinafter referred to as a "hole inner peripheral surface film") 52 is formed on the inner peripheral surface of the small diameter hole portion 44. On the other hand, such film is not formed on an inner peripheral surface of the stepped portion 48 (hereinafter referred to as a "shoulder portion contacting surface") with which the shoulder portion 40 contacts or an inner peripheral surface of the large diameter hole portion 46. That is, the base material of the cylinder head 18 is exposed at the shoulder portion contacting surface or the inner peripheral surfaces. The heat shield film 50 or 52 is a thermal spraying film made from ceramics such as zirconia ($ZrO_2$), silica ($SiO_2$), silicon nitride ($Si_3N_4$), yttria ($Y_2O_3$) and titania ($TiO_2$) or compound ceramics such as cermet (TiC, TiN), mullite ($3Al_2O_3.SiO_2$), cordierite ($2MgO.2Al_2O_3.5SiO_2$) and steatite ($MgO.SiO_2$).

The thermal spraying film made from the material described above has lower conductivity and lower volumetric specific heat than the base material of the cylinder head 18. Therefore, according to the heat shield film 50 or 52, followability of temperature of a heat shield film forming face to temperature of working gas in the combustion chamber 20 is enhanced, and various effects can be obtained. More specifically, temperature of the heat shield film forming face is lowered at an intake stroke of the engine 10 and thus, excessive heating of intake gas is suppressed in the intake stroke. Therefore, occurrence of knocking can be restrained satisfactorily. Also, temperature of the heat shield film forming face is increased well in an explosion stroke of the engine 10. Therefore, a cooling loss in the explosion stroke can be reduced and fuel efficiency can be increased.

In the present embodiment, the material of the head bottom surface film 50 is the same as that of the hole inner peripheral surface film 52. Therefore, the thermal conductivity and volumetric specific heat are equal between these films. However, these films are different in regard to thickness. As shown in FIG. 2, the hole inner peripheral surface film 52 is thicker than the head bottom surface film 50. More specifically, the thickness of the head bottom surface film 50 is from 10 to 100 μm and that of the hole inner peripheral surface film 52 is from 100 to 500 μm.

Thermal capacity of a heat storage material (kJ/° C.) is expressed by a product of volume of the heat storage ($m^3$) and volumetric specific heat (kJ/$m^3$° C.). Then, the thermal capacities of two heat shield film with the same material and surface area will be proportional to their film thickness. Suppose that the surface area of the two films are equivalent, then the thermal capacity of the hole inner peripheral surface film 52 is higher than that of the head bottom surface film 50 formed around an opening portion of the small diameter hole portion 44. In other words, the hole inner peripheral surface film 52 is higher in heat retaining effect than the head bottom surface film 50 around the opening portion.

Figure 3:
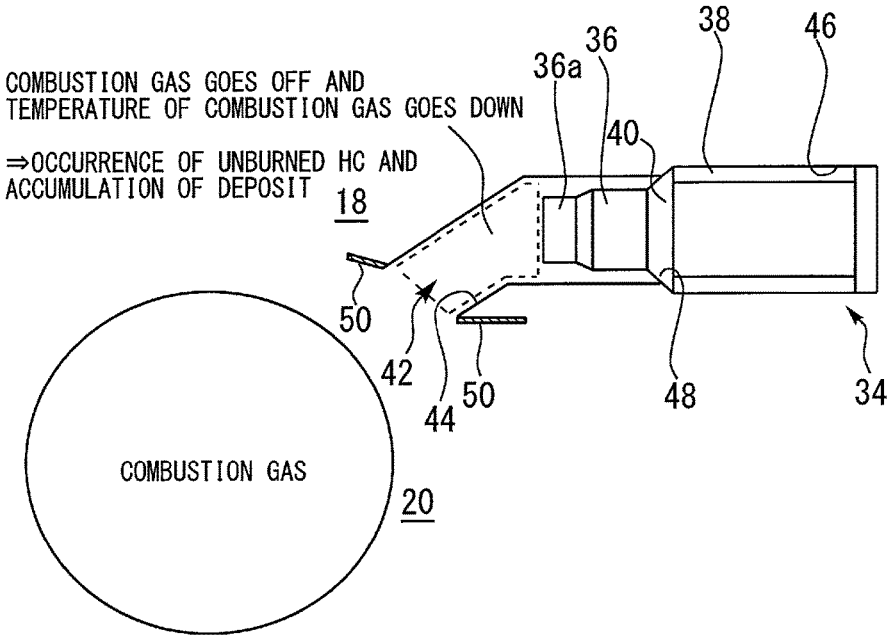
FIG. 3 is a diagram for describing advantageous effects of the first embodiment of the present application.

An effect of the present embodiment is described with reference to FIGS. 3 to 4. An internal combustion engine shown in FIG. 3 comprises the bottom surface of the cylinder head 18 on which a heat shield film 50 is formed whereas such film is not formed on the inner peripheral surface of the installation hole 42 including the small diameter hole portion 44 and the base material of the cylinder head 18 is exposed at the inner peripheral surface. Therefore, combustion gas generated in the combustion chamber 20 loses its momentum to go off in the small diameter hole portion 44 where by temperature of the gas in the small diameter hole portion 44 goes down and thus, unburnt HC easily occurs in the small diameter hole portion 44. And the occurrence of unburnt HC provokes accumulation of deposit onto the inner peripheral surface of the small diameter hole portion 44 and the surface of the small diameter portion 36.

Figure 4:
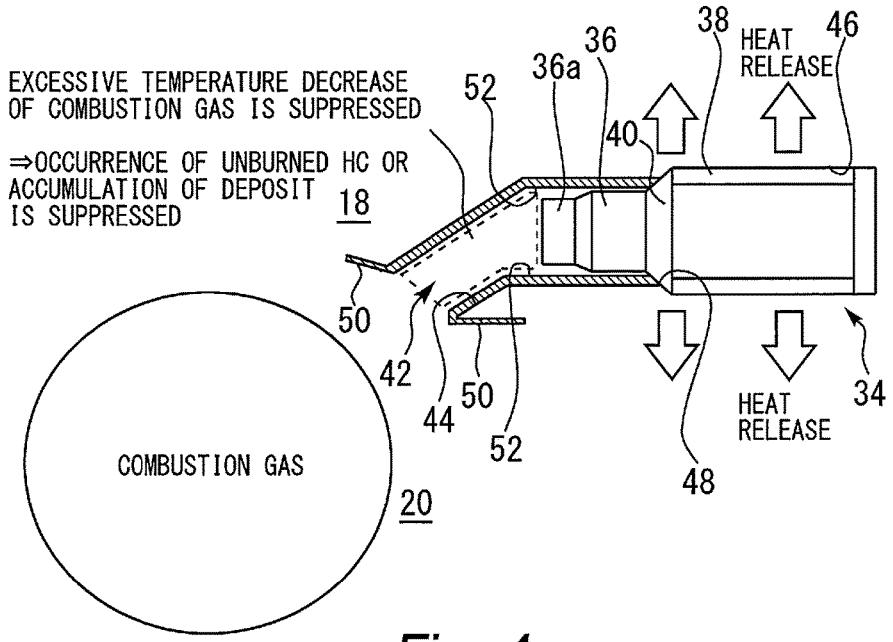
FIG. 4 is a diagram for describing advantageous effects of the first embodiment of the present application.

In this regard, heat retaining effect of the hole inner peripheral surface film 52 is increased in an internal combustion engine shown in FIG. 4, i.e. the engine 10 of the present embodiment. Therefore, the combustion gas generated in the combustion chamber 20 is suppressed to lose its momentum around the small diameter hole portion 44. Even if the combustion gas goes off around the small diameter hole portion 44, excessive temperature decrease of the combustion gas in the small diameter hole portion 44 is suppressed. For the reasons described above, the occurrence of unburned HC inner the small diameter hole portion 44 or the accumulation of deposit is suppressed.

Moreover, in the present embodiment, the heat shield film 52 is formed on the inner peripheral surface of the small diameter hole portion 44 whereas such film is not formed on the shoulder portion contacting surface or the inner peripheral surface of the large diameter hole portion 46, and the base material of the cylinder head 18 is exposed thereat. Therefore, if the temperature of the cylinder pressure sensor 34 rises due to heat of the combustion gas, heat of the cylinder pressure sensor 34 can be easily released into the cylinder head 18 via the shoulder portion contacting surface and the inner peripheral surface of the large diameter hole portion 46. For the reasons described above, an excessive rise in temperature of the cylinder pressure sensor 34 is suppressed and thus, occurrence of thermal distortion in the pressure receive portion 36*a* can be suppressed.

Figure 5:
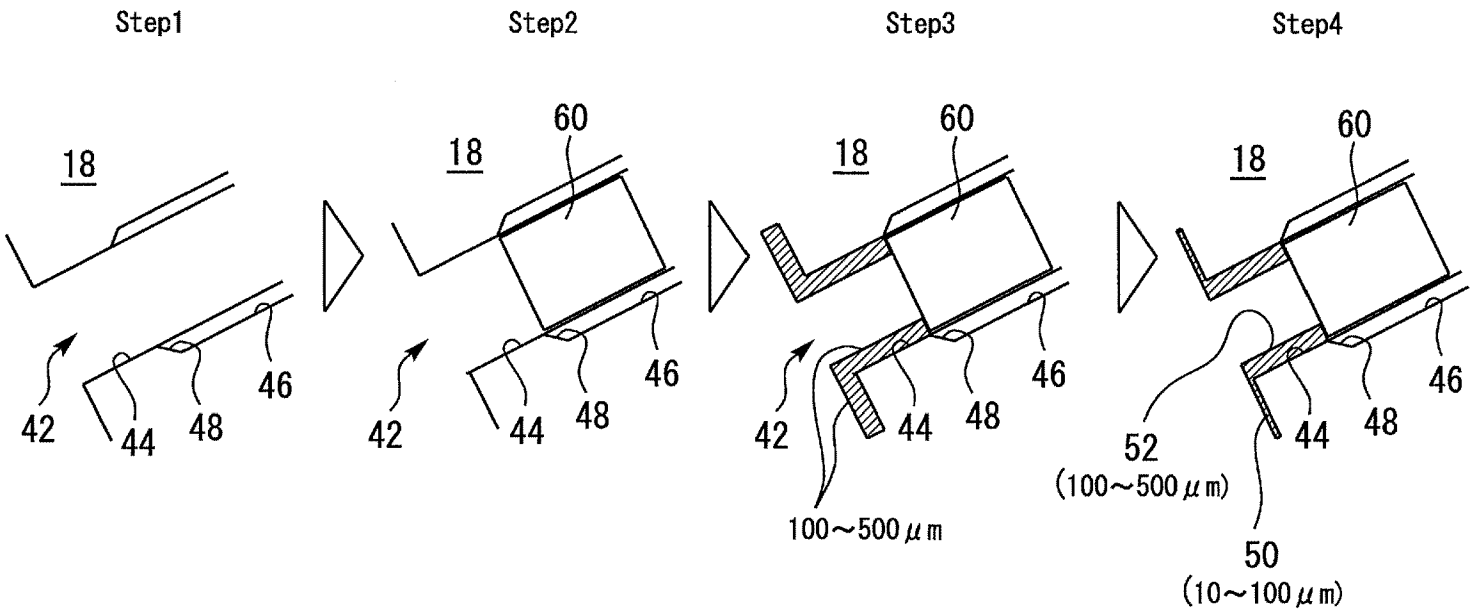
FIG. 5 is a diagram for describing a forming method example of a heat shield film.

FIG. 5 is a diagram for describing a forming method example of the head bottom surface film 50 and the hole inner peripheral surface film 52. In the forming method shown in FIG. 5, the cylinder head 18 is prepared at first (Step 1). For example, a plurality of cores to form the intake port 22 and the exhaust port 24 are installed inside a casting and then a base material such as aluminum alloy is poured into the casting to mold a cylinder head body. Then, the installation hole 42 or the like are formed on the cylinder head body by carrying out drilling work and the inner peripheral surface of the small diameter hole portion 44 is cut as needed, whereby the cylinder head 18 is prepared.

After the preparation of the cylinder head 18, a mask member 60 is set in the installation hole 42 (Step 2). As for the setting method of the mask member 60, but should not be limited to, it is desirable to set the mask member 60 so that its end portion located near the small diameter hole portion 44 contacts with the stepped portion 48 so that spray materials do not attach to a part of the surface of the installation hole 42 located at far side from the stepped portion 48 (i.e. inner side of the cylinder head 18).

After the setting of the mask member 60 in the installation hole 41, the film material described above is sprayed to the bottom surface of the cylinder head 18 and the inner peripheral surface of the small diameter hole portion 44 and then a thermal spraying film with thickness from 100 to 500 μm is formed (Step 3). Since air bubbles are formed on the surface of the thermal spraying film and inside the thermal spraying film, thermal conductivity and volumetric specific heat of the obtained thermal spraying film become lower than those of the base material of the cylinder head 18. Note that thermal spraying method can adopt various methods such as, but should not be limited to, frame thermal spraying, high-speed frame thermal spraying, arc thermal spraying, plasma thermal spraying, laser thermal spraying and the like.

Finally, the thermal spraying film formed on the bottom of the cylinder head 18 is processed (Step 4). The processing method is not especially limited to, but the thermal spraying film may be processed by cutting work with an end mill or by plane cutting with a grindstone. As needed, the surface of the thermal spraying film is smoothed on the inner peripheral surface of the small diameter hole portion 44. As a result, the head bottom surface film 50 with thickness from 10 to 100 μm and the hole inner peripheral surface film 52 with thickness from 100 to 500 μm are formed.

According to the present embodiment described above, since the head bottom surface film 50 and the hole inner peripheral surface film 52 are formed, followability of temperature of the heat shield film forming face to temperature of working gas in the combustion chamber 20 is enhanced, and various effects can be obtained. Also, since the films are made from the same film material while the thickness of the hole inner peripheral surface film 52 is larger than that of the head bottom surface film 50, heat retaining effect of the hole inner peripheral surface film 52 is relatively increased and thus, the occurrence of unburned HC inner the small diameter hole portion 44 or the accumulation of deposit can be suppressed. Moreover, the shoulder portion contacting surface or the inner peripheral surface of the large diameter hole portion 46 makes it possible for the cylinder pressure sensor 34 to release heat into the cylinder head 18, whereby the excessive rise in temperature of the cylinder pressure sensor 34 can be suppressed.

Note that in the present embodiment, the shoulder portion contacting surface corresponds to the seal surface of the present application.

Incidentally, the first embodiment is described on the assumption that the head bottom surface film 50 or the hole inner peripheral surface film 52 is a thermal spraying film. However, these heat shield films are not limited to the thermal spraying films but any films made from the same film material with lower thermal conductivity than the base material of the cylinder head 18 can be used. For example, a film (anodizing film) obtained by anodizing process of the bottom surface of the cylinder head 18 can be used instead of the thermal spraying film since it has lower thermal conductivity and lower volumetric specific heat than the base material of the cylinder head 18. The same holds for a film obtained by spraying method or dipping method with coating material including ceramics or compound ceramics described above and binder impregnated with hollow particles. Also, a film obtained by spraying method or dipping method with the coating material while excluding the hollow particles can be used since it has lower thermal conductivity than the base material of the cylinder head 18. Note that this variation is also applicable in detailed description of the second embodiment described below.

Also, the first embodiment is described on the assumption that the internal combustion engine is a park ignition type internal combustion engine. However, as described above, there is a diesel type internal combustion engine with a cylinder head to which a sensor to detect pressure in the combustion chamber is mounted. Therefore, when an installation hole for the cylinder pressure sensor has an inner peripheral surface like the shoulder portion contacting surface, a heat shield film like the hole inner peripheral surface film 52 can be formed on the inner peripheral surface in the same manner as the first embodiment. For the reasons described above, even if the internal combustion engine is a diesel type internal combustion engine, when the engine has an inner peripheral surface like the shoulder portion contacting surface, a heat shield film like the hole inner peripheral surface film 52 can be formed on the inner peripheral surface.

Second Embodiment

Figure 6:
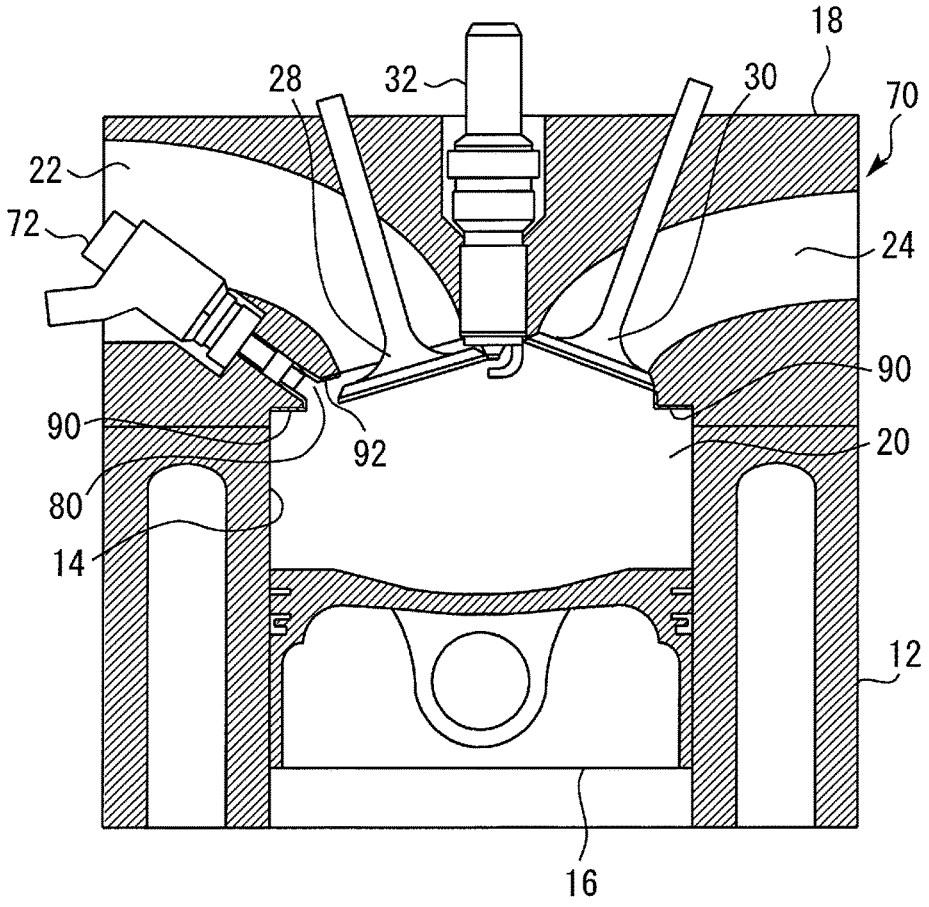
FIG. 6 is a diagram for describing a construction example of an internal combustion engine in a second embodiment of the present application.

An internal combustion engine of a second embodiment of the present application belongs to the same type engine as the first embodiment (i.e. a spark ignition type internal combustion engine). FIG. 6 is a diagram for describing a construction example of an internal combustion engine in a second embodiment of the present application. As shown in FIG. 6, the internal combustion engine 70 comprises the cylinder block 12, the cylinder 14, the piston 16, and the cylinder head 18. It can be understood by comparing FIG. 6 with FIG. 1 that the engine 70 comprises a cylinder injector 72 instead of the cylinder pressure sensor 34 of the engine 10. The cylinder injector 72 is configured to inject fuel into the combustion chamber 20.

Figure 7:
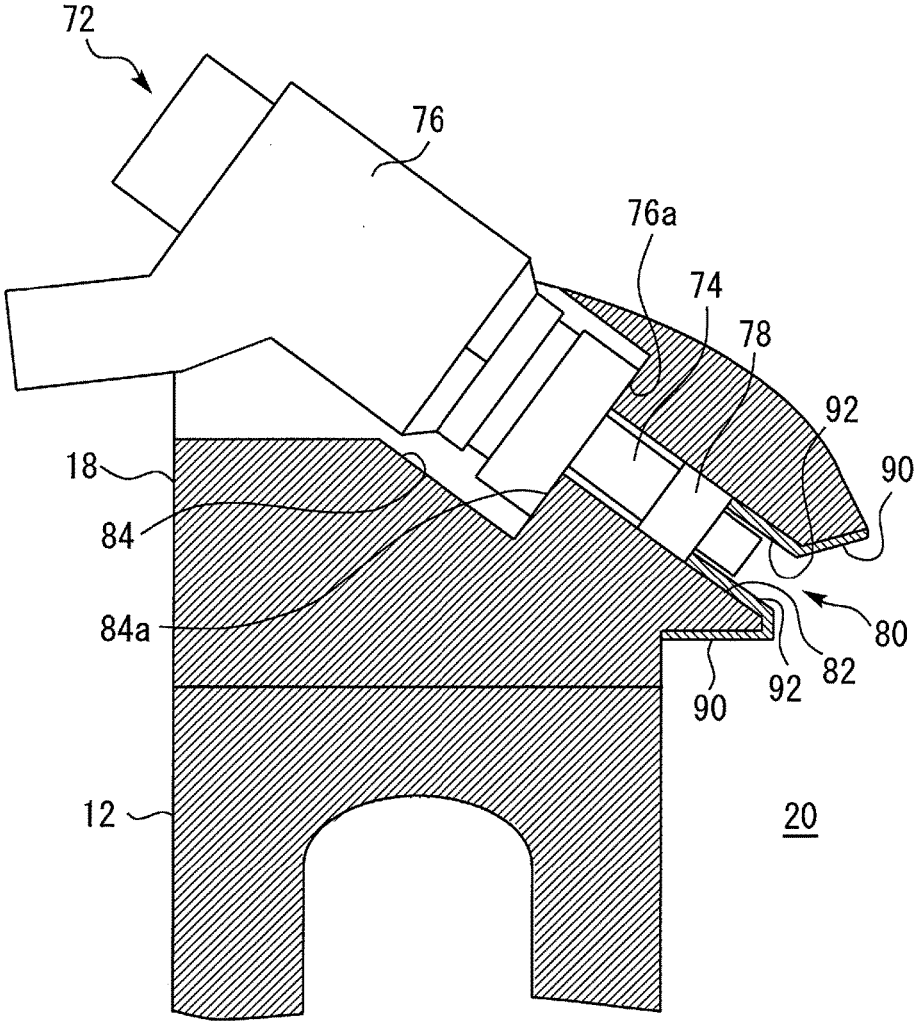
FIG. 7 is a diagram for showing a mounting structure example of the cylinder injector of FIG. 6.

For example, the cylinder injector 72 is constructed as shown in FIG. 7. The cylinder injector 72 of FIG. 7 comprises a small diameter nozzle 74 which has a valve element (not shown) housed in a tip side of the nozzle 74 at the combustion chamber side, a nozzle holder which has larger diameter than the nozzle 74, and a sealing ring 78 which is mounted at midway of the nozzle 74.

The cylinder injector 72 is an electromagnetic type fuel injector. The cylinder injector 72 is configured to drive to open and close the valve element with an excitation coil (not shown).

As shown in FIG. 7, an installation hole 80 is formed on the cylinder head 18 in which the cylinder injector 72 is housed. The installation hole 80 comprises a small diameter hole portion 82 which opens at one end into the combustion chamber 20, and a large diameter hole portion 84 which has larger diameter than the small diameter hole portion 82. On the large diameter hole portion 84, a seat surface **84*a* is formed to oppose to a shoulder portion 76*a* which is located at tip of the nozzle holder 76 at the combustion chamber side. When the shoulder portion 76*a* is seated on the seat surface 84*a*, the nozzle 74 is positioned in the small diameter hole portion 82 with an interval from an inner peripheral surface of the portion 82 while the sealing ring 78 contacts with the portion 82** to seal between them.

As shown in FIGS. 6 and 7, a heat shield film (hereinafter referred to as a "head bottom surface film") 90 is formed on the bottom surface of the cylinder head. Also, a heat shield film (hereinafter referred to as a "hole inner peripheral surface film") 92 is formed on a contacting surface of the inner peripheral surface of the portion 82 with the sealing ring 78 (hereinafter referred to as a "ring contacting surface"). On the other hand, such film is not formed on a part of the surface of the installation hole 80 located at far side from the ring contacting surface (i.e. inner side of the cylinder head 18). The base material is exposed in the inner peripheral surface of the small diameter hole portion 82 and the seat surface **84*a***.

The heat shield film 90 or 92 is a thermal spraying film made from the same film material, i.e. ceramics or compound ceramics described above. As shown in FIG. 7, the thickness of the hole inner peripheral surface film 92 is larger than that of the head bottom surface film 90. The thickness of the head bottom surface film 90 is from 10 to 100 μm and that of the hole inner peripheral surface film 92 is from 100 to 500 μm.

According to the present embodiment, various effects like the effects described in first embodiment can be obtained. That is, according to the heat shield film 90 or 92, followability of temperature of a heat shield film forming face to temperature of working gas in the combustion chamber 20 is enhanced. Therefore, occurrence of knocking can be restrained satisfactorily and also a cooling loss in the explosion stroke can be reduced and fuel efficiency can be increased. In addition, since the material of the head bottom surface film 90 is the same as that of the hole inner peripheral surface film 92, the occurrence of unburned HC in an area of the small diameter hole portion 82 nearer to the combustion chamber 20 than the sealing ring 78. Moreover, the ring contacting surface or the seat surface **84*a* makes it possible for the cylinder injector 72 to release heat into the cylinder head 18, whereby the excessive rise in temperature of the cylinder pressure sensor 34** can be suppressed.

Note that in the present embodiment, the ring contacting surface corresponds to the seal surface of the present application.

Incidentally, the second embodiment is described on the assumption that the internal combustion engine is a park ignition type internal combustion engine. However, as described above, there is a diesel type internal combustion engine with a cylinder head to which a fuel injector is mounted. Therefore, when an installation hole for the cylinder injector has an inner peripheral surface like the ring contacting surface, a heat shield film like the hole inner peripheral surface film 92 can be formed on the inner peripheral surface in the same manner as the second embodiment. For the reasons described above, even if the internal combustion engine is a diesel type internal combustion engine, when the engine has an inner peripheral surface like the ring contacting surface, a heat shield film like the hole inner peripheral surface film 92 can be formed on the inner peripheral surface.

What is claimed is:

1. An internal combustion engine comprising a cylinder head with an installation hole to which a sensor configured to detect pressure in a combustion chamber or an injector configured to inject fuel in the combustion chamber is mounted, wherein the engine further comprises a heat shield film which has lower thermal conductivity than a base material of the cylinder head, the heat shield is formed on both a bottom of the cylinder head constituting a wall surface of the combustion chamber and an inner peripheral surface of the installation hole, the heat shield film on the bottom surface and the heat shield film on the inner peripheral surface are made from the same film material, wherein the heat shield film on the inner peripheral surface is thicker than that of the heat shield on the bottom surface.

2. The internal combustion engine according to claim 1, wherein the inner peripheral surface comprises a seal surface configured to contact with a part of the sensor or the injector so as to seal between the inner peripheral surface and the combustion chamber, wherein the heat shield film on the inner peripheral surface is formed on an area nearer to the combustion chamber than the seal surface whereas the base material is exposed in an area further to the combustion chamber than the seal surface.

* * * * *